United States Patent [19]

Fantetti

[11] 4,309,780

[45] Jan. 12, 1982

[54] TOILET SEAT AND COVER THEREFOR

[75] Inventor: Giuseppe Fantetti, Brescia, Italy

[73] Assignee: I.C.S. Cidneo S.p.A., Barletta, Italy

[21] Appl. No.: 131,707

[22] Filed: Mar. 19, 1980

[30] Foreign Application Priority Data

Oct. 11, 1979 [IT] Italy ..... 5232 A/79

[51] Int. Cl.[3] ..... A47K 13/00

[52] U.S. Cl. ..... 4/234; 4/236; 4/240

[58] Field of Search ..... 4/234, 236, 240, 237, 4/235

[56] References Cited

U.S. PATENT DOCUMENTS

| | | | |
|---|---|---|---|
| 323,018 | 7/1885 | Atkins | 4/236 |
| 1,681,277 | 8/1928 | Booth | 4/236 |
| 3,608,100 | 9/1971 | Trost | 4/236 |
| 4,197,596 | 4/1980 | Fantetti | 4/236 |

FOREIGN PATENT DOCUMENTS

| | | | |
|---|---|---|---|
| 454519 | 6/1950 | Italy | 4/236 |

*Primary Examiner*—Henry K. Artis

[57] ABSTRACT

A pair of anchoring means are secured to the rear portion of a toilet bowl by means of a suitable fastener. The head end of the anchoring means which have an annular groove formed therein extend above the toilet bowl and are positioned in similarly sized and shaped openings in a supporting plate to which the toilet seat is pivotally coupled. A pair of rotatable locking pins each having a notch therein extend through the supporting plate for selective engagement and disengagement with the respective annular groove in the head end of the anchoring means.

7 Claims, 7 Drawing Figures

TOILET SEAT AND COVER THEREFOR

FIELD OF THE INVENTION

The present invention relates generally to toilet seats and, more particularly, to a toilet seat and cover therefor which are readily and easily assembled and disassembled.

BACKGROUND OF THE INVENTION

It is well known to assemble a toilet seat and the cover therefor to the bowl by means of a pair of T-shaped supports which, on the one hand, have to be attached to the bowl by means of screws and, on the other hand, have to form pivot means that allow the opening and closing of the cover with respect to the seat as well as of the seat itself. The difficulties encountered in the centering and mounting of the seat and of the cover on the T-shaped supports, as well as the difficulties met in disassembling the toilet seat are very well known. This is especially true when considering the awkward positions in which these operations have to be carried out and the rusty condition of the screws after an even short period of use.

There are already known several improvements on the above arrangement, such as the use of fastening means of the bolt type. However, this requires a special construction of the toilet bowl and the use of the toilet seat cover is limited to such a bowl configuration.

SUMMARY OF THE INVENTION

It is, therefore, an object of the present invention to provide a toilet seat and cover therefor, which are applicable to any type of toilet bowl by means of locking elements that are easily positionable in the use and rest positions through lever means and without affecting the configuration of the bowl.

It is another object of the invention to provide a toilet seat and cover having blocking means that are fully accessible so as not to prevent access thereto from any direction or angle whatever, thus improving the ease of cleaning of the bowl.

Briefly stated, the seat cover of the present invention is pivoted, together with its respective seat, on a plate-like support which is mounted on a pair of anchoring elements that are attached to the bowl. The seat cover is thus locked thereto by rotary locking means that are tangentially oriented with respect to the anchoring elements, so as to engage a peripheral groove provided thereon. The locking means or pins have a lateral notch that permits the disengagement thereof from the anchoring elements during the assembly and disassembly of the seat-cover combination and from the toilet bowl.

THE DRAWINGS

Greater details of the invention will become apparent from the following description thereof and from the accompanying drawings which are merely illustrative and not limitative of the invention, and in which.

DETAILED DESCRIPTION OF THE INVENTION

Figure 1:
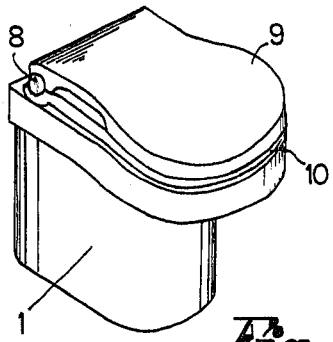
FIG. 1 is a perspective view of the present invention comprising a toilet bowl with toilet seat and toilet cover assembled thereon.
Figure 5:
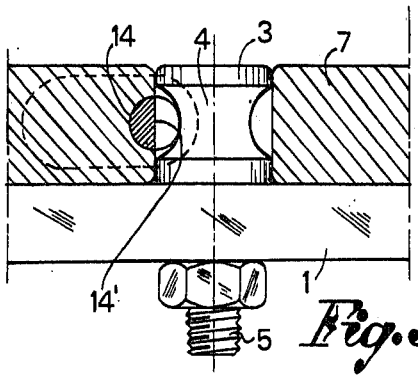
FIG. 5 is a detailed elevational view partially in section and on an enlarged scale of a portion of the structure shown in FIG. 3, but with the locking means of this invention in position to permit the assembly and disassembly of the toilet seat.
Figure 3:
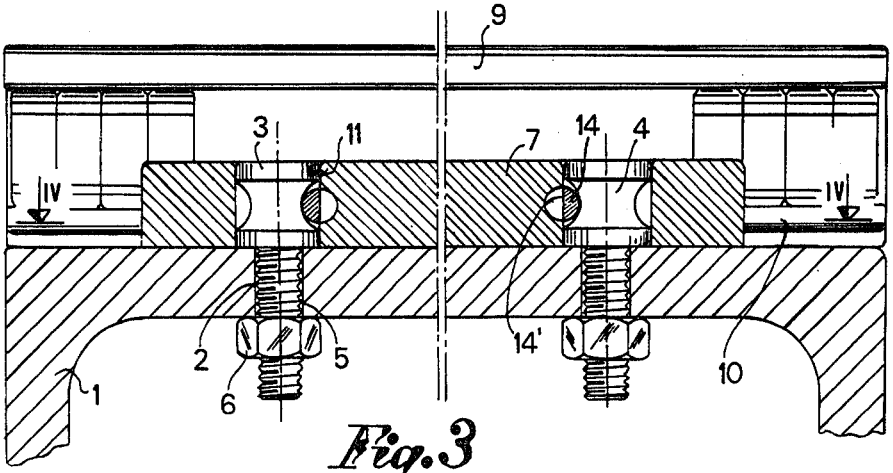
FIG. 3 is a sectional elevational view of the toilet seat and cover mounted on the bowl and taken along line III—III of FIG. 2.

With reference now to the drawings, the body of toilet bowl 1 is provided in its rear portion with a pair of vertically oriented clearance holes 2 and spaced from each other in the direction of the bowl's width. In each hole 2 there is attached an anchoring stud 3 the head portion of which protrudes above the body of the toilet bowl 1 and has, preferably but not necessarily, a substantial cylindrical shape with an intermediate peripheral undercut or annular groove 4 as shown best in FIGS. 3 and 5. Each anchoring stud 3 has a threaded shank 5 extending downwardly through its respective clearance hole 2 in the bowl body 1. The shank 5 is engaged by a nut 6 which acts beneath the body of the bowl so as to attach the toilet seat 10 to the bowl 1, as shown in FIGS. 3 and 5 of the drawings.

To the anchoring stud 3 there is removably attached a supporting plate 7 which carries, by means of hinges 8, hereinafter more fully described, both the toilet seat 10 and the seat cover 9 associated therewith. On the supporting plate 7 there are provided two apertures 11 having a shape and dimension corresponding to those of the head portion of the anchoring stud 3. This will allow the apertures 11 to correctly receive the anchoring studs 3. On the supporting plate 7, in a direction which intersects each aperture 11, there is further provided a horizontal, counterbored opening 12 for receiving and guiding a rotatable locking pin 13. This pin 13 serves the purpose of cooperating with the anchoring means 3 when the locking pin 13 is seated in the respective aperture 11 of the supporting plate 7. Each locking pin 13 has in its middle area a full portion 14 with a notch 14'. The notch 14' has a radius corresponding to that of the aperture 11, so that when the notch 14' is facing the aperture 11, its surface results in a circular continuation or extension of the surface of the aperture 11. Each locking pin 13 has, furthermore, on its portion facing toward the front of the toilet bowl, a head 13' which rests against a counterbore 15 provided for this purpose in the horizontal opening 12 of the supporting plate 7. On the opposed end, that is at the extremity facing the back of the toilet bowl, the locking pin 13 is provided with a lever 16 that is attached by means of a spine or a pin 17 for example. In this manner, each locking pin 13 cannot move axially within the opening 12. Conversely, by turning the lever 16 it is possible to rotate the locking pin 13 180 degrees about its axis, so as to position the respective intermediate full portion 14 (or the respective notch 14') toward the aperture 11.

Figure 4:
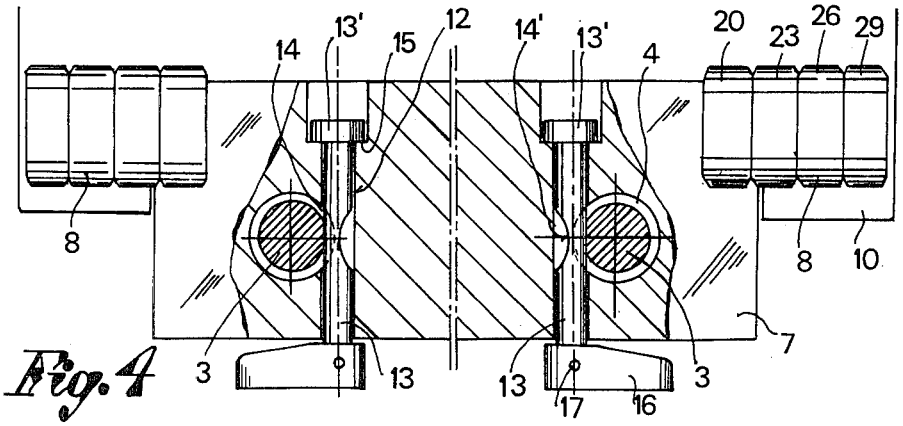
FIG. 4 is a plan view partially broken away and partially in section taken along line IV—IV of FIG. 3.

When the notches 14' of the locking pins 13 are facing toward the apertures 11 of the supporting plate 7 (see FIG. 5), it is possible to position the supporting plate on the head portion of the anchoring means 3 that have been previously placed in the holes 2 of the toilet bowl 1. It is, therefore, sufficient to position the anchoring means 3 within apertures 11 of the supporting plate 7 in order to obtain a correct centering of the supporting plate 7 and therewith, consequently, of the toilet seat 10 and cover 9 upon the toilet bowl 1. At this point, to lock the supporting plate 7 on the bowl 1 it suffices to rotate the levers 16 and therefore the locking pins 13 180 degrees until engagement is obtained of the respective full portions 14 in the undercuts or grooves 4 of the anchoring means 3, as shown in FIGS. 3 and 4 of the accompanying drawings. This action prevents any possibility of detachment between the anchoring means 3, the supporting plate 7 and the toilet seat-cover assembly.

In order to have a more effective and reliable locking action, the anchoring means 3 and locking pins 13 may be made of plastic material, so as to exploit the elastic properties of the material when coupling one element to the other. Further, the radius of the undercuts or grooves 4 of the anchoring means 3 may be calculated as a function of the diameter of the locking pins 13 so that the action of the full portions 14 thereof might yield a correct centering of the supporting plate 7 on the toilet bowl, and might generate forces that augment the anchoring effect of the seat-cover assembly.

To disassemble the assembled toilet seat and cover from the toilet bowl 1, it is sufficient to rotate the levers 16 in the opposed direction (opposed to the locking direction) until the anchoring means 3 are disengaged from the locking action of the full portions 14 of the locking pins 13, as clearly shown in FIG. 5 of the accompanying drawings.

Figure 6:
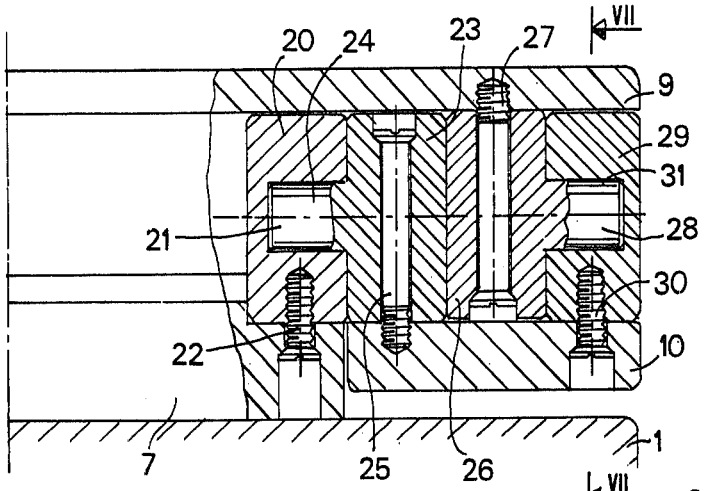
FIG. 6 is a fragmentary plan view partially broken away and partially in section illustrating the pivoting hinge between the toilet seat and toilet cover and with respect to the supporting plate-like element.
Figure 7:
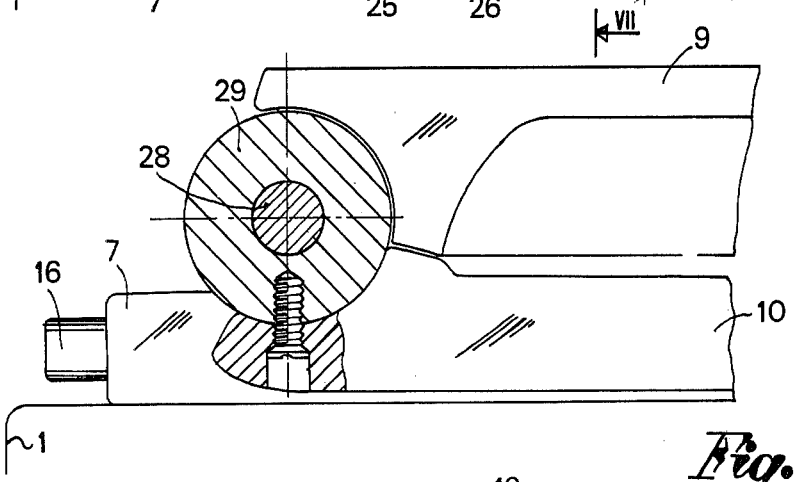
FIG. 7 is an enlarged, fragmentary elevational view partially in section taken along lines VII—VII of FIG. 6.
Figure 2:
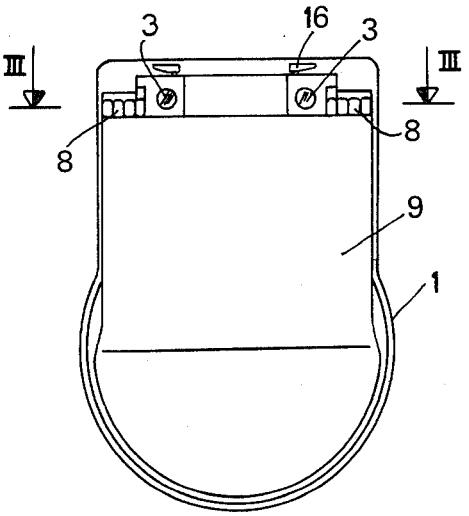
FIG. 2 is a top plan view of the seat cover of the invention mounted on the bowl.

As to the hinges 8 of the toilet seat and cover and of those connecting this assembly to the supporting plate 7, each hinge 8 comprises, preferably and according to the illustration given in FIGS. 6 and 7 of the drawings, a first cylindrical member 20 having a horizontal opening 21 therein and attached by a vertical fastener 22 to the supporting plate 7, and a second cylindrical member 23 having a horizontal pivot 24 positioned in the opening 21 of the first member 20. The second member 23 is, in turn, attached to the toilet seat 10 by means of a vertical fastener 25. The hinge 8 comprises furthermore, a third cylindrical member 26 attached to the seat cover 9 by means of a vertical fastener 27 and having a horizontal pivot 28. A fourth cylindrical member 29 is attached to the seat 10 by a vertical fastener 30 and has a horizontal opening 31 for seating and guiding the pivot 28 of the third member 26.

Such a hinge permits the angular movement of opening and closing the seat cover 9 onto the supporting plate 7 independently of the seat 10. Also permitted are the angular movements of the seat 10 both together with the cover 9 and separate therefrom, when the cover 9 is displaced from the toilet bowl 1.

What is claimed is:

1. A toilet seat and cover therefor, particularly for use with a toilet bowl having a pair of vertically oriented clearance holes in its rear, upper part, said toilet seat being pivotably connected to the cover therefor, said toilet seat and cover assembly comprising: a supporting plate pivotably attached to said toilet seat and said seat cover and having a pair of horizontal openings therein; a pair of vertically oriented apertures in said supporting plate; a pair of anchoring means positioned in said vertically oriented apertures; a pair of locking pins mounted and guided in said horizontal openings in said supporting plates, said locking pins intersecting said apertures of said supporting plate; an intermediate portion in each of said locking pins for engaging and disengaging said anchoring means upon rotation by 180 degrees in one direction and in the opposite direction, respectively, of said locking pins.

2. The toilet seat and cover of claim 1, wherein on each locking pin there is provided, in the intermediate part thereof, a full portion for engagement in an annular groove provided in the respective locking means.

3. The toilet seat and cover of claim 1, wherein each of said locking pins has, in the intermediate part thereof, a notch having a radius substantially equal to the radius of each of said vertical apertures that receive said anchoring means; the surface of each said notch being the circular continuation of the surface of said respective aperture when said notch is facing toward said aperture.

4. The toilet seat and cover of claim 1, wherein each of said locking pins comprises, at a first extremity thereof, a head resting in a counterbore provided in said horizontal opening for said locking pin and, at a second extremity thereof, a lever adapted to rotate said locking pins during the locking and unlocking of said anchoring means.

5. The toilet seat and cover of claim 1, wherein the axes of each anchoring means and respective locking pin are oriented in perpendicular planes.

6. The toilet seat and cover of claim 1, wherein each anchoring means is attached to said toilet bowl by means of a threaded shank extending through the respective clearance hole of said bowl and secured by a nut screwed on said shank.

7. The toilet seat and cover of claim 1, wherein at least one hinge is provided to attach said toilet seat and cover to said supporting plate, said hinge comprising a first cylindrical member having an axial opening and being attached to said supporting plate; a second cylindrical member attached to said toilet seat and having an axial pin guided within said opening of said first cylindrical member; a third cylindrical member attached to said seat cover and having an axial pin therein; and a fourth cylindrical member attached to said toilet seat and having an axial opening therein for seating and guiding said pin of said third cylindrical member.

* * * * *